US007443409B2

(12) United States Patent
Sako

(10) Patent No.: US 7,443,409 B2
(45) Date of Patent: Oct. 28, 2008

(54) THERMAL PRINTHEAD

(75) Inventor: Teruhisa Sako, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 111 days.

(21) Appl. No.: 11/587,626

(22) PCT Filed: Apr. 26, 2005

(86) PCT No.: PCT/JP2005/007903

§ 371 (c)(1),
(2), (4) Date: Oct. 27, 2006

(87) PCT Pub. No.: WO2005/105462

PCT Pub. Date: Nov. 10, 2005

(65) Prior Publication Data

US 2007/0211133 A1 Sep. 13, 2007

(30) Foreign Application Priority Data

Apr. 30, 2004 (JP) ..... 2004-135122

(51) Int. Cl.
*B41J 2/335* (2006.01)

(52) U.S. Cl. ..... 347/204

(58) Field of Classification Search ..... None
See application file for complete search history.

(56) References Cited

U.S. PATENT DOCUMENTS

| | | | |
|---|---|---|---|
| 6,236,423 | B1 | 5/2001 | Yamaji |
| 6,445,402 | B1 | 9/2002 | Kinjyo et al. |

FOREIGN PATENT DOCUMENTS

| | | |
|---|---|---|
| JP | 7-186429 | 7/1995 |
| JP | 11-301001 | 11/1999 |
| JP | 2000-141729 | 5/2000 |
| JP | 2000-255089 | 9/2000 |
| JP | 2001-47652 | 2/2001 |

OTHER PUBLICATIONS

International Search Report from corresponding PCT.JP2005/007903 application, mailed Aug. 9, 2005.

*Primary Examiner*—K. Feggins
(74) *Attorney, Agent, or Firm*—Hamre, Schumann, Mueller & Larson, P.C.

(57) ABSTRACT

A thermal printhead (A) according to the present invention includes a heating resistor (5) formed on a substrate (1), an electrode (3) for energizing the heating resistor (5), and a protection film (6) for covering the heating resistor (5) and the electrode (3). The protection film (6) has a surface with a ten-point mean roughness of no smaller than 0.2 μm.

2 Claims, 6 Drawing Sheets

THERMAL PRINTHEAD

TECHNICAL FIELD

The present invention relates to a thermal printhead used as a component of a thermal printer.

BACKGROUND ART

FIG. 6 illustrates a conventional thermal printhead (see patent document 1, for example) used as a component of a thermal printer. The illustrated thermal printhead B includes an insulating substrate 91 and a glaze layer 92 made of e.g. glass formed on the substrate. The glaze layer 92 is formed with an electrode 93 and a heating resistor 95. The heating resistor 95 and the electrode 93 are covered by a protection film 96 mainly containing glass material. A platen roller P is provided at a position facing the heating resistor 95.

In printing with the above thermal printhead, the platen roller P presses thermal recording paper S, which is an example of print mediums, onto the protection film 96, while the thermal recording paper S is moved in the secondary scanning direction (right-left direction in FIG. 6). Here, heat generated at the heating resistor 95 is transmitted to the thermal recoding paper S through the protection film 96 for developing color, in other words, printing.

In printing with a thermal printhead, so-called sticking may occur. Sticking is a phenomenon in which the thermal recording paper sticks to the surface of the protection film and thus paper feed of the thermal recording paper is disturbed. The sticking may result in defective printing such as white streaks left on the thermal recording paper.

A method for preventing incidence of sticking may be to reduce friction resistance due to the sliding contact between the thermal recording paper and the protection film. In the conventional thermal printhead shown in FIG. 6, the surface of the protection film 96 is formed to be smooth. Specifically, the protection film 96 has a ten-point mean roughness Rz (JIS B 0601) generally of no more than 0.1 μm. However, even if the surface of the protection film 96 is smooth, the sticking may occur.

For reducing the friction resistance between thermal recording paper and a protection film, a thermal printhead may be arranged in a following manner. Specifically, in this thermal printhead, the protection film has two-layer structure including an insulating layer for covering the heating resistor and the electrode, and a conductive layer for covering the insulating layer (see patent document 2, for example). In this way, static electricity due to contact friction between the surface of the protection film and the thermal recording paper can be efficiently discharged by the conductive layer. Thus, it is possible to prevent the thermal recording paper from adhering to the surface of the protection film due to the static electricity. Still, this arrangement of thermal printhead cannot eliminate the incidence of sticking.

Another method for preventing incidence of sticking may be to reduce the force for pressing the thermal recording paper onto the protection film. However, in this method, heat is not sufficiently transmitted to the thermal recording paper, thereby deteriorating the print quality.

Patent Document 1: JP-A-07-186429

Patent Document 2: JP-A-2001-47652

DISCLOSURE OF THE INVENTION

The present invention has been proposed under the above-described circumstances. It is therefore an object of the present invention to provide a thermal printhead capable of preventing incidence of sticking and thus enhancing the print quality.

A thermal printhead according to the present invention comprises a heating resistor formed on a substrate, an electrode for energizing the heating resistor, and a protection film for covering the heating resistor and the electrode. The protection film has a surface with a ten-point mean roughness of no smaller than 0.2 μm.

Preferably, the protection film may comprise a first layer formed on the heating resistor and the electrode, and a second layer formed on the first layer.

Preferably, the second layer may be porous, and the first layer may be non-porous.

Preferably, the second layer may be conductive, and the first layer may be electrically insulating.

BEST MODE FOR CARRYING OUT THE INVENTION

A preferred embodiment of the present invention is specifically described below with reference to the accompanying drawings.

Figure 1:
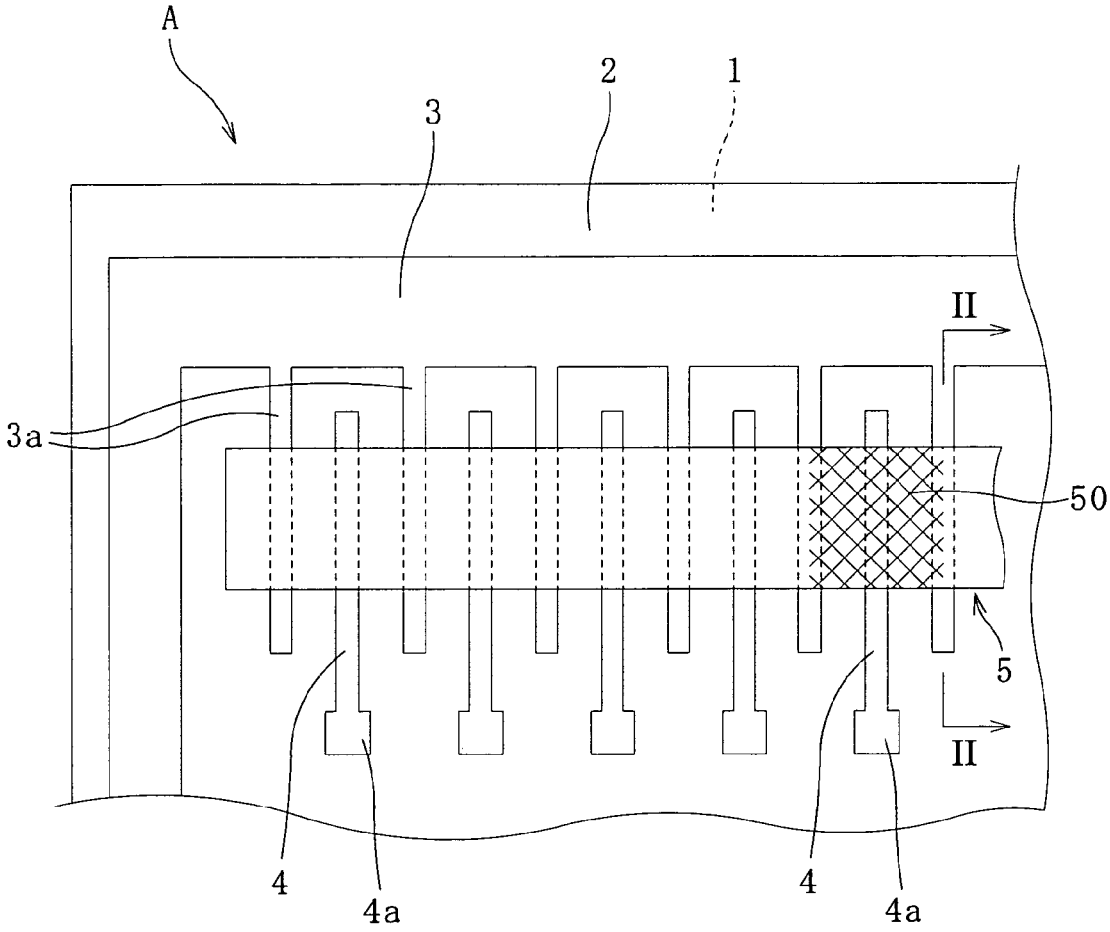
FIG. 1 is a plan view schematically illustrating the principal portions of an example of a thermal printhead according to the present invention.
Figure 2:
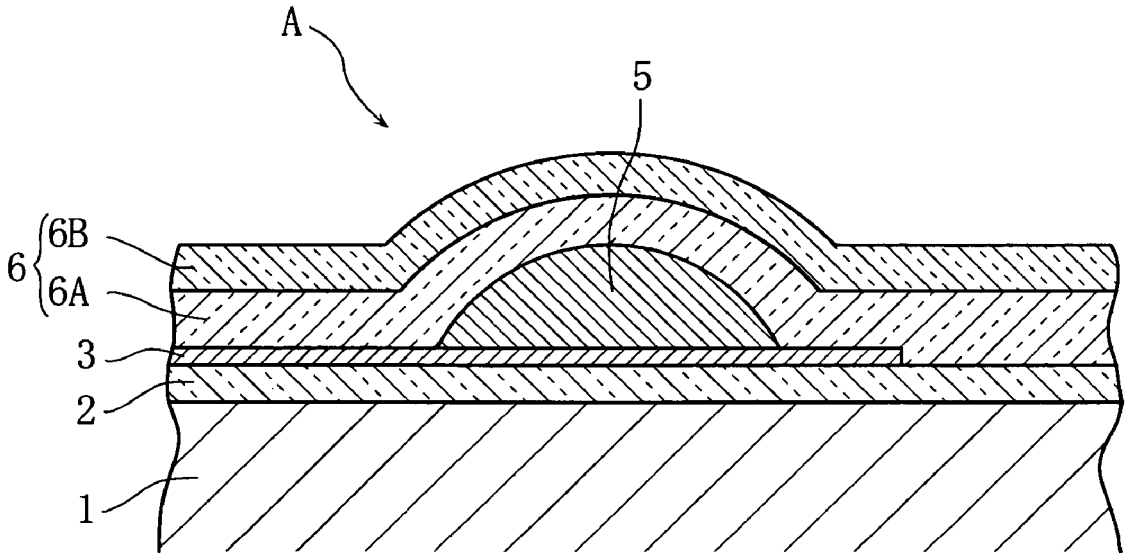
FIG. 2 is a sectional view taken along the lines II-II of FIG. 1.

FIGS. 1 and 2 illustrate an example of a thermal printhead according to the present invention. The thermal printhead A according to the present embodiment includes a substrate 1, a glaze layer 2, a common electrode 3, a plurality of individual electrodes 4, a heating resistor 5, and a protection film 6. In FIG. 1, the protection film 6 is omitted.

The substrate 1 is nonconductive and made of e.g. alumina ceramic. The glaze layer 2 is formed by printing and baking glass paste to cover substantially the whole of the upper surface of the substrate 1. The glaze layer 2 serves as a heat storage layer. The glaze layer 2 has a smooth surface formed with the common electrode 3 and the individual electrodes 4, and facilitates the bonding of the common electrode 3 and others.

The common electrode 3 includes a plurality of branches 3*a* extending like comb-teeth. An end portion of each of the individual electrodes 4 is positioned between a pair of adjacent branches 3*a*. The other end portion of each of the individual electrodes 4 is formed with a bonding pad 4*a*. These bonding pads 4*a* are electrically connected with output pads of non-illustrated drive ICs. The common electrode 3 and the individual electrodes 4 are formed by printing and baking gold resinate paste, for example.

The heating resistor 5 is formed into a strip with a predetermined width extending in a predetermined direction of the substrate 1, so as to bridge the branches 3*a* and the individual electrodes 4. The heating resistor 5 is formed by printing and baking ruthenium oxide paste, for example. In the thermal printhead A, the individual electrodes 4 are selectively energized by the non-illustrated drive ICs, so that a plurality of regions 50 (one of them represented by cross-hatching, for example) of the heating resistor 5 generate heat, serving as a heating dot defined by a pair of adjacent branches 3*a*.

The protection film 6 covers the surfaces of the common electrode 3, the individual electrodes 4, and the heating resistor 5. As shown in FIG. 2, the protection film 6includes an electrically insulating first layer 6A and a conductive second layer 6B. The first layer 6A is formed by printing and baking glass paste containing $SiO_2$, $B_2O_3$, or PbO, for example. The second layer 6B is a porous layer covering the first layer 6A, and its surface has a ten-point mean roughness Rz of no smaller than 0.2 μm.

The second layer 6B is formed in the following process, for example.

First, conductive glass paste is printed on the first layer 6A to form a conductive glass paste layer, which is to be baked at a temperature lower than the softening point of the glass contained. The conductive glass paste is a mixture of glass paste mainly containing $SiO_2$, ZnO, and CaO, and a resistor paste. The resistor paste is made by adding ruthenium oxide grains with a grain size of 0.001-1 μm to a glass containing e.g. PbO, $SiO_2$, and $B_2O_3$. The amount of ruthenium oxide contained in the conductive glass paste is 0.3-30 wt %.

It is favorable that the softening points of the glass paste and the resistor paste are higher than the softening point of the first layer 6A (the softening point of the above-described glass paste $SiO_2$—$B_2O_3$—PbO is 680° C.). The softening point of the glass paste is 785° C., and the softening point of the resistor paste is 865° C.

The baking temperature of the conductive glass paste is 760° C. As this baking temperature (760° C.) is lower than the softening point of the glass paste and of the resistor paste, the glass component of the conductive glass paste layer does not flow, and ruthenium oxide grains are surrounded by air bubbles which form air gaps. In this way, the second layer 6B is formed to be a porous layer. As the softening point of the first layer 6A (680° C.) is lower than the baking point of the second layer 6B (760° C.), the first layer 6A is softened in baking the second layer 6B to be fixed to the second layer 6B intimately.

Figure 3:
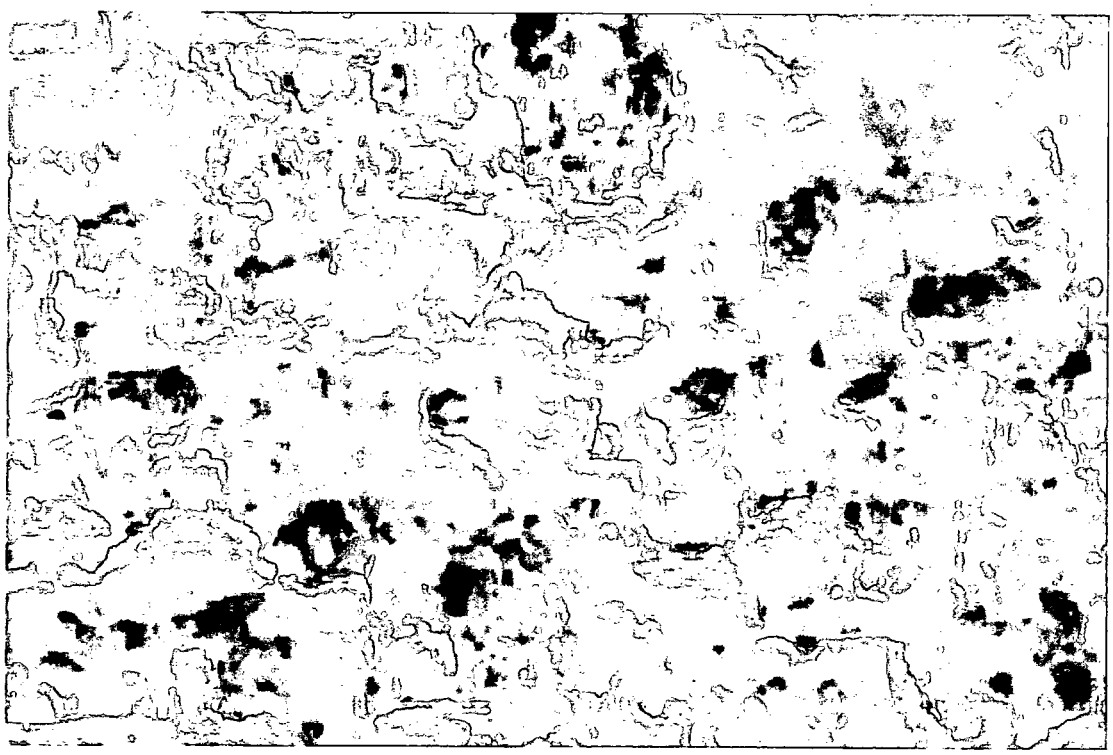
FIG. 3 is a micrograph showing a surface of a protection film of the thermal printhead according to the present invention.

FIG. 3 is a micrograph, taken at 1500 magnifications, of the surface of the second layer 6B formed in the above-described process. As shown, the second layer 6B is a porous layer with a large number of air gaps. These air gaps are irregularly dispersed throughout the second layer 6B. The shapes of the air gaps are also irregular. Thus, the surface of the second layer 6B is irregular as seen in a vertical section. Therefore, even if the second layer 6B is grinded for surface treatment, the second layer 6B has a ten-point mean roughness Rz of no smaller than 0.2 μm. It should be noted that the above-described process for forming the second layer 6B is only an example. When the baking temperature of the conductive glass paste or other conditions are changed, the size of the air gaps formed in the second layer 6B is changed, and thus the surface roughness of the second layer 6B is also changed.

Figure 4:
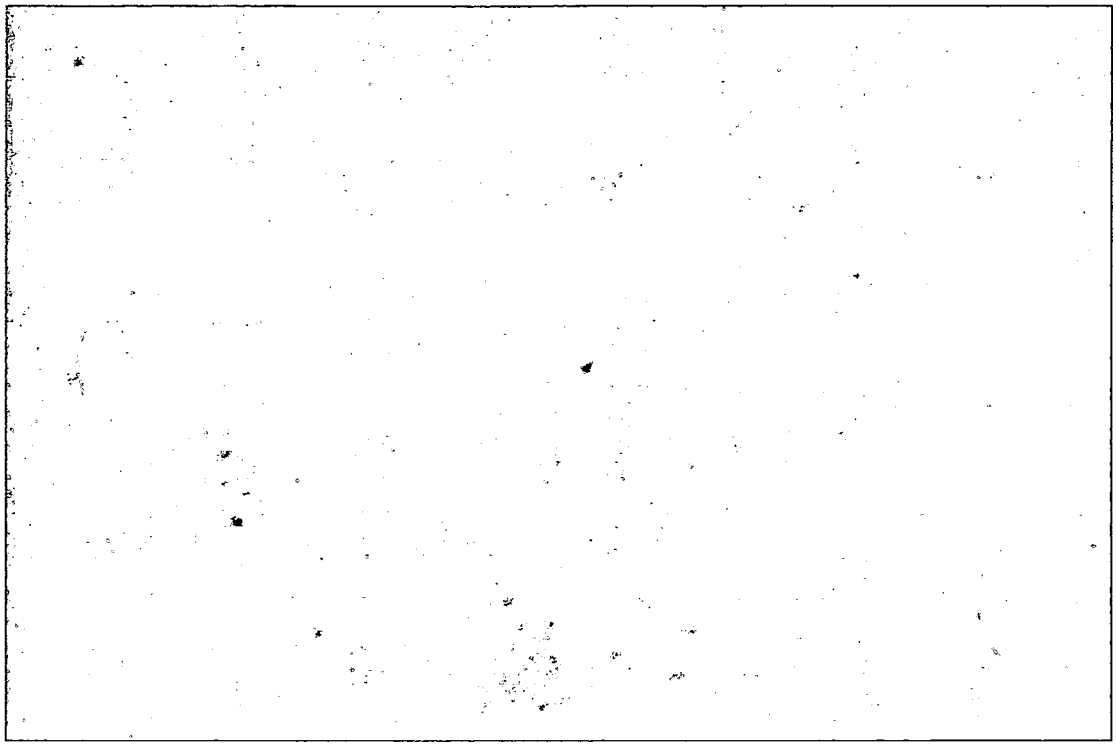
FIG. 4 is a micrograph showing a surface of a protection film of a conventional thermal printhead.

FIG. 4 is a micrograph of the surface of the protection film of the conventional thermal printhead, taken at the same magnifications as the micrograph in FIG. 3. As shown, the surface of the protection film is smooth and has a ten-point mean roughness Rz of no greater than 0.1 μm. When printing is performed with such protection film, the above-described sticking occurs, resulting in defective printing with e.g. white streaks. Through diligent research, the present inventor came to focus on the relationship between the surface roughness of the protection film and the incidence of sticking, and found that sticking can be efficiently prevented when the ten-point mean roughness of the protection film is no smaller than 0.2 μm. This indicates that, when the surface of the protection film is formed rough, which is contrary to the conventional arrangement, the contacting area between thermal recording paper and the protection film is reduced, thereby reducing the incidence of sticking.

Next, the above matter is specifically described below, based on experiments performed by the present inventor.

A plurality of thermal printheads with protection films each having different surface roughness were prepared for printing on thermal recording paper, and the printing quality was evaluated. Each of the protection films of the thermal printheads had different surface roughness by changing the size of grains in ruthenium oxide, the baking temperature of the protection film, and other conditions. When the baking temperature of the protection film was higher than the baking temperature of the conductive glass paste, the protection film was formed to be non-porous, and a thermal printhead having a conventional arrangement was made.

Conditions other than the protection film were the same in all examples. The experiment was performed utilizing thermal recording paper (model number: 135LAB) of Ricoh Co., Ltd., under conditions with temperature of 34° C. and humidity of 90%.

Figure 5:
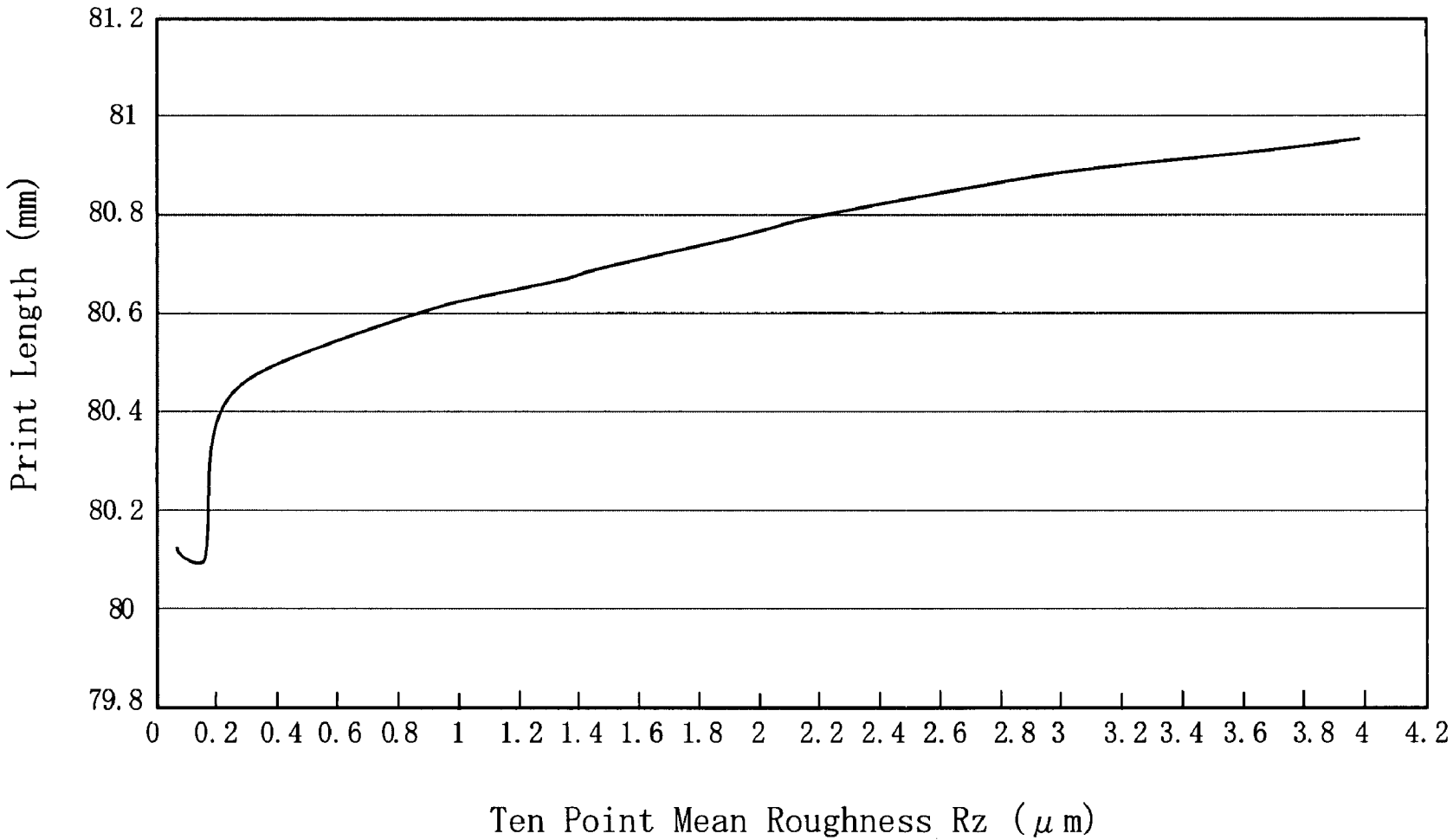
FIG. 5 is a graph illustrating the relationship between the surface roughness of the protection film and the print length.
Figure 6:
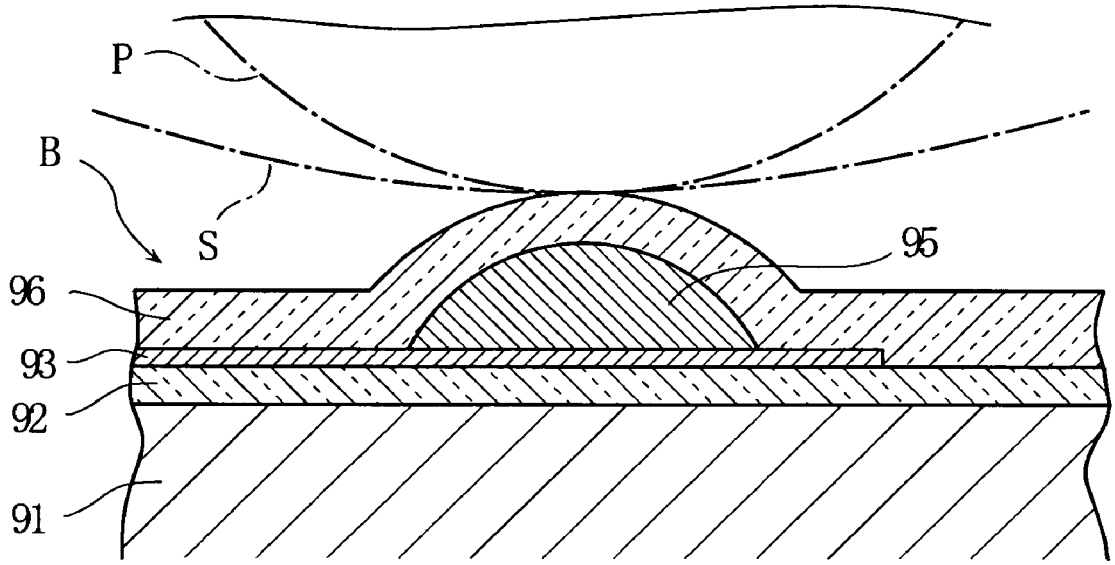
FIG. 6 PRIOR ART
FIG. 6 is a sectional view illustrating the principal portions of the conventional thermal printhead.

FIG. 5 is a graph showing the relationship between the surface roughness of the protection film of the thermal printhead and "print length". Here, "print length" represents the length of printed marks as seen in the secondary scanning direction of the printhead, printed on the thermal recording paper based on predetermined printing data. If the sticking occurs, paper feed of the thermal recording paper is temporarily stopped, and thus the print length of printed data becomes shorter than that of the same data printed without sticking. Thus, by checking the print length, the incidence of sticking can be examined.

As shown in the graph, when the protection film had a surface roughness Rz smaller than 0.2 μm, the print length was remarkably shorter than when the surface roughness was no smaller than 0.2 μm. It can be seen from this that when the surface roughness Rz is no smaller than 0.2 μm, the sticking can be prevented and thus the print quality is enhanced. Further, when performing an experiment utilizing other various commercially available thermal recording paper, the sticking was prevented with a surface roughness Rz of no smaller than 0.2 μm, and a result similar to the experiment utilizing the above-described thermal recording paper was obtained.

As described above, the protection film 6 has two-layer structure including the first layer 6A as a lower layer and the second layer 6B as an upper layer laminated on the former. The first layer 6A properly achieves the expected function as a protection film such as insulation and water resistance for the common electrode 3, the individual electrodes 4, and the heating resistor 5. The second layer 6B is formed as a porous layer as described above, and thus the surface of the second layer 6B is formed to have an appropriate surface roughness larger than a predetermined value.

As the second layer 6B is porous and thus has a surface roughness larger than a predetermined value, even when the layer is worn in contact with the thermal contacting paper, its function for preventing the sticking can be properly maintained. Further, as the first layer 6A is electrically insulating and the second layer 6B is conductive, no electrification due to friction between the second layer 6B and the thermal recording paper occurs, thereby preventing trouble in feeding the thermal recording paper that would otherwise be caused by the electrification.

In addition to the above-described experiment, the present inventor further performed an experiment utilizing a thermal printhead provided with a single-layered insulating protection film containing inorganic oxide. In this experiment, the surface roughness of the protection film was varied by changing conditions such as the additive rate of the inorganic oxide, and the baking temperature of the protection film. This experiment showed that, even if the protection layer has only one layer, the sticking can be prevented when the layer has a surface roughness Rz of no smaller than 0.2 μm, similarly to the above-described protection film having two layers. As seen from this, even with a single-layered protection film, it is possible to efficiently prevent the sticking by simply forming the protection film to have an appropriate surface roughness larger than a predetermined size. Further, there is no need to reduce the force to press the thermal recording paper onto the protection film for prevention of the sticking, thereby enhancing the print quality.

The present invention is not limited to the above-described embodiments. Specific structures of the thermal printhead according to the present invention may be variously modified within the spirit and scope of the invention.

For example, the surface of the protection film is not necessarily porous. Further, the protection film does not necessarily have the two-layer structure including the insulating layer and the conductive layer, but may have only one insulating layer. In other words, if the protection film has a surface roughness of no smaller than 0.2 μm, it may adopt any lamination state or components.

It is favorable that the present invention is used for printing on thermal recording paper, but may also be used to print on non-thermal recording paper utilizing a thermal ink ribbon.

The thermal printhead according to the present invention is not limited to have a flat glaze layer, but may have a glaze layer with projections. The thermal printhead may be of a thin-film type or a thick-film type.

The invention claimed is:

1. A thermal printhead comprising: a heating resistor formed on a substrate, an electrode for energizing the heating resistor, and a protection film for covering the heating resistor and the electrode;

wherein the protection film has a surface with a ten-point mean roughness of no smaller than 0.2 μm;

wherein the protection film comprises a first layer formed on the heating resistor and the electrode, and a second layer formed on the first layer; and wherein the second layer is porous, and the first layer is non-porous.

2. The thermal printhead according to claim 1, wherein the second layer is conductive, and the first layer is electrically insulating.

* * * * *